US005860550A

United States Patent [19]

Miller et al.

[11] Patent Number: 5,860,550

[45] Date of Patent: Jan. 19, 1999

[54] CONTAINER WITH OVERLAPPING PERIPHERAL FLANGES

[75] Inventors: Charles Daniel Miller, Rockford; Joseph M. Kornick, Chicago, both of Ill.; Robert W. Pritchard, Pittsburgh, Pa.

[73] Assignee: SmithKline Beecham Corporation, Philadelphia, Pa.

[21] Appl. No.: 956,334

[22] Filed: Oct. 23, 1997

Related U.S. Application Data

[63] Continuation of Ser. No. 286,146, Aug. 4, 1994, abandoned.

[51] Int. Cl.[6] ..... B65D 6/28; B65D 51/00

[52] U.S. Cl. ..... 220/4.23; 220/339; 220/602; 220/663; 220/377; 206/45.31; 206/535

[58] Field of Search ..... 220/4.21, 4.22, 220/4.23, 4.24, 326, 339, 377, 377.1, 602, 662, 663, 664, 665; 206/45.31, 535

[56] References Cited

U.S. PATENT DOCUMENTS

| | | | |
|---|---|---|---|
| 2,687,157 | 8/1954 | Cowan . | |
| 2,842,178 | 7/1958 | Solomon . | |
| 3,043,354 | 7/1962 | Fitzgerald | 220/4.23 |
| 3,401,269 | 9/1968 | Tabet | 220/663 X |
| 3,415,407 | 12/1968 | Alden et al. | 220/4.23 |
| 3,524,564 | 8/1970 | Schurman | 220/377 X |
| 4,213,536 | 7/1980 | Hafner | 220/663 |
| 4,361,226 | 11/1982 | Travis . | |
| 4,401,230 | 8/1983 | Hall . | |
| 4,454,958 | 6/1984 | Juillet et al. | 220/339 |
| 4,494,651 | 1/1985 | Malcolm | 206/328 |
| 4,687,129 | 8/1987 | Cugley | 220/339 X |
| 4,962,854 | 10/1990 | Ricci | 206/387 |
| 4,986,414 | 1/1991 | Ashley et al. . | |
| 5,105,959 | 4/1992 | Kinsley | 215/227 |
| 5,246,133 | 9/1993 | James | 220/377 |
| 5,449,088 | 9/1995 | Howard et al. | 220/662 |
| 5,486,172 | 1/1996 | Chess | 220/602 X |
| 5,526,953 | 6/1996 | Chieng | 220/4.23 |

FOREIGN PATENT DOCUMENTS

| | | |
|---|---|---|
| 2223253 | 10/1974 | France . |
| 195493 | 4/1923 | United Kingdom . |
| WO 96/04176 | 2/1996 | WIPO . |

OTHER PUBLICATIONS

Color photocopies (3 photos on 1 page) of a "prior art" transparent box at the Patent Office of the Republic of China (Taiwan). Date unknown.

An English language translation of an Office Action in related Taiwan Patent Application No. 85101449 dated 10 Dec. 1996, 2 pages, referring (at ¶ 3 in Action) to transparent box of above color photocopies.

*Primary Examiner*—Stephen K. Cronin

*Attorney, Agent, or Firm*—Panitch Schwarze Jacobs & Nadel, P.C.

[57] ABSTRACT

Containers for storing and displaying an object are provided which include a first base member having a transparent area located such that an object to be placed within the container is visible through the transparent area when the container is in a closed position. The containers also include a second base member and a hinge interconnecting the first and the second base members. The first base member is movable with respect to the second base member between a closed position in which the peripheral edges are releasably latchable and an open position in which the base members are at least partially spaced from each other. The closed position defines a hollow interior space for receiving an object to be placed therein. Containers for storing objects which, while not including a transparent area, also include overlapping flanges coextensive with each base member are also provided.

19 Claims, 3 Drawing Sheets

CONTAINER WITH OVERLAPPING PERIPHERAL FLANGES

This is a continuation of application Ser. No. 08/286,146, filed Aug. 4, 1994 now abandoned.

FIELD OF THE INVENTION

The present invention relates a container for the storage of an object. More particularly, it relates to a container for a medicament.

BACKGROUND OF THE INVENTION

Containers useful for storing or containing solid medicaments to be used in the home or at a stationary location typically include either a cardboard container or a plastic bottle. For convenience purposes, however, it is preferred that some medicaments, particularly over-the-counter medicaments such as cold remedies, pain relievers, vitamins and the like, be stored in containers which are easily portable in the user's pocket or purse. When the user of such a medicament carries the container in his or her pocket or purse, however, the container is subjected to an increased risk of damage from impact and to increased stress from frequent use and manipulation both of which act to break the container or more easily force the container open subjecting the contents of the container to contamination or loss.

Portable containers, such as a metal box used for throat lozenges, are known in the art. However, many prior art containers open too easily under the stresses of portable use due to weak materials of construction or insufficient closure mechanisms. Other portable prior art containers have the opposite problem, namely, they are difficult to open, particularly for the elderly or those with conditions which adversely affect manual dexterity. Attempts to improve the closures of some of the prior art containers, such as by use of safety cap features make it overly difficult for the user of a typical over-the-counter or prescription medicament to open the portable container. In addition, most portable containers do not allow the user of the medicament to view the contents of the container without opening the container.

Therefore, there is a need in the art for a portable medicament container which is of a size that easily fits within a pocket or purse, and which sufficiently withstands the increased risk of damage and stress derived from portable use without inadvertently opening, but which remains easy to open upon application of manual force by the user. Further, a need exists for such a container which also includes a feature wherein the contents of the container may be easily viewed through a portion of the container without requiring the user to open the container.

The present invention provides a portable medicament container having an improved positive closure strong enough to withstand the stress of portable use, but which is easily opened by the user. In addition, the present invention provides such a portable container which also includes a transparent area which allows the user to view a portion of the contents of the container without opening the container.

SUMMARY OF THE INVENTION

The present invention includes a container for storing and displaying an object. The container comprises a first base member, a second base member and a hinge. The first base member has an exterior surface, an interior surface, a peripheral edge and a transparent area. The transparent area is located such that an object to be placed within the container is visible through the transparent area when the container is in the closed position. The second base member has an exterior surface, an interior surface, and a peripheral edge. The hinge interconnects the first and second base members such that the first base member is movable with respect to the second base member between a closed position and an open position. The closed position defines a hollow interior space for receiving an object to be placed therein. In the closed position, the peripheral edges of the first and second base members are coupled. The open position comprises a position wherein the first and second base members are uncoupled except at the hinge and are at least partially spaced from each other. The first and second base members are releasably latchable in the closed position.

In an alternative embodiment, the invention includes a container for storing an object. The container comprises a first base member, a second base member and a hinge. The first base member has an exterior surface, an interior surface and a peripheral edge. The peripheral edge of the first base member comprises an exterior flange which is coextensive with the exterior surface of the first base member and extends from the peripheral edge of the first base member. The second base member has an exterior surface, an interior surface and a peripheral edge. The peripheral edge of the second base member comprises an interior flange which is coextensive with the interior surface of the second base member and extends from the peripheral edge of the second base member. The hinge interconnects the first and second base members such that the first base member is movable with respect to the second base member between a closed position and an open position. The closed position defines a hollow interior space for receiving an object to be placed therein. In the closed position, the exterior flange and the interior flange overlap. The open position defines a position wherein the first and second base members are uncoupled except at the hinge and are at least partially spaced from each other. The first and second base members are releasably latchable in the closed position.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings, like numerals are used to indicate like elements throughout the several views.

DETAILED DESCRIPTION OF THE PREFERRED EMBODIMENTS

Figure 1:
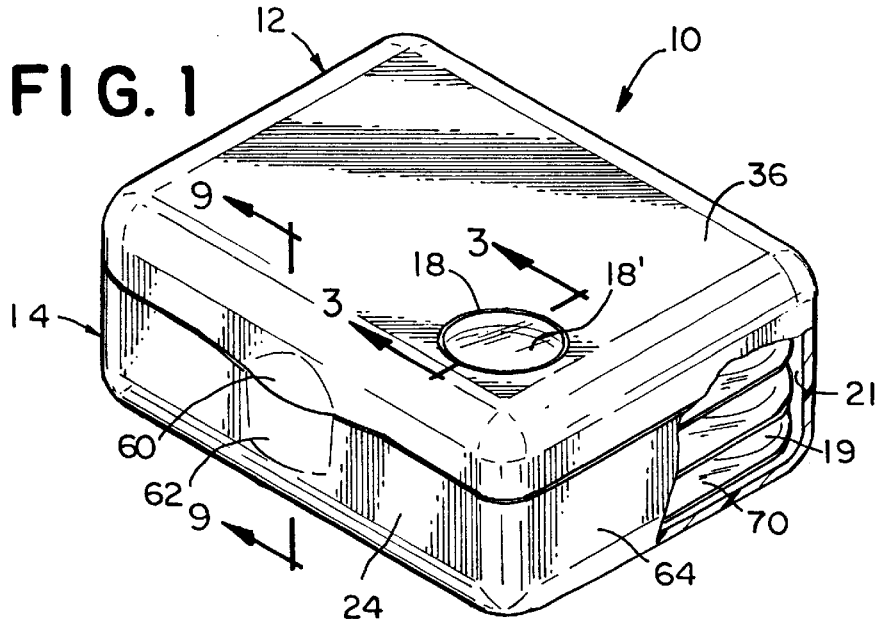
FIG. 1 is a perspective view, partially broken away, of a container according to the present invention in the closed position.

Certain terminology is used in the following description for convenience only and is not limiting. The words "right," "left," "lower" and "upper" designate directions in orientation of FIGS. 1 and 2 of the drawings to which reference is made. The words "inwardly" and "outwardly" refer to directions toward and away from, respectively, for example, the geometric center of the container and parts thereof. The terminology includes the words above specifically mentioned, derivatives thereof, and words of similar import.

Referring now to the drawings in detail, there is shown in FIGS. 1–9, preferred embodiments of a container, generally designated as 10, according to the present invention.

The container 10 includes a first base member 12, a second base member 14 and a hinge 16. The first base member includes a transparent area 18. While the drawings show the first base member 12 as a top lid for the container 10 and the second base member 14 as a bottom for the container 10, it should be understood, based upon this disclosure, that the first and second base members 12, 14 may be reversed without departing from the scope of the invention. The container 10 in its closed position, as shown in FIG. 1, may have any of a variety of geometric configurations in plan view, including, square, rectangular, circular, hexagonal, triangular, ovoid and the like. Preferably, the container 10 has an overall generally square or generally rectangular parallelepiped configuration in which the container has six adjoining surfaces at generally right angles to one another, preferably with rounded adjoining edges and corners as shown. More preferably, the container 10 is generally rectangular on each surface.

The first base member 12, second base member 14 and hinge 16 may be made of any suitable packaging material including metal, plastic, cardboard and similar materials. However, preferably the first base member 12, the second base member 14 and the hinge 16 are made of a moldable thermoplastic or thermosetting polymeric material including, for example, polyolefin, polystyrene, polyvinyl chloride, polyacrylate, polylacetate and copolymers, mixtures and blends thereof. More preferably, the first base member 12, the second base member 14 and the hinge 16 are made of a recyclable thermoplastic material such as a polyolefin, for example, polypropylene or polyethylene. The presently preferred material is polypropylene.

Preferably, the first and second base members 12, 14 are opaque, except for the transparent area 18. Opacity may be provided in any suitable manner, including using opaque materials, or incorporating a suitable dye or pigment in the plastic material forming the container. It is presently preferred to blend a titanium dioxide white pigment in the plastic material. Of course, other types and carriers for pigments or dyes and other colors may be used.

The transparent area 18, is preferably a transparent member 18' which is separate from the first and second base members 12, 14 and secured to an area 18 such as the open transparent area 18 in the first base member 12. The transparent area 18 is located such that an object, such as object 19 shown in FIG. 1, to be placed within the container is visible through the transparent area 18 when the container is in the closed position. Preferably, only one object 19 is visible through the transparent member 18' which is preferably sized and shaped in a configuration substantially similar to the object 19, although the transparent member 18' may be of such size and shape that more than one object is visible therethrough, if desired. The transparent member 18', or window, is preferably also made of a moldable, transparent thermoplastic material. "Transparent" as used herein, also includes the term "translucent". It is preferred, however, that the material is sufficiently light transmissive such that someone viewing an object through the transparent member 18' may discern the nature of the object 19. The transparent member 18' is preferably also colorless, however, a color may also be provided to the transparent member 18' by coating, mixing, or blending the material forming the transparent member 18' with a dye and/or pigment by any suitable method. More preferably, the window 18' is made of a moldable, recyclable polyolefin such as, for example, homopolymers and copolymers of polypropylene and polyethylene. The presently preferred material for the window 18' is clarified polypropylene.

The transparent member 18' may be secured to the open transparent area 18 by any suitable method. Preferably, the transparent member 18' is spin welded to the first base member 12. Alternatively, the transparent member 18' is preferably insert molded into the first base member 12. The transparent member 18' may also be formed to be integral with the first base member 12, such as by co-molding techniques. It will be understood, from this disclosure, that other suitable methods may also be used to secure the transparent member 18' to the first base member 12 including, for example, heat- or pressure-sensitive adhesives.

Figure 3:
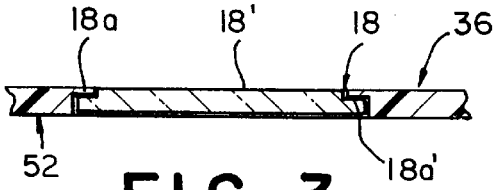
FIG. 3 is an enlarged, partial cross-sectional view taken along line 3—3 of FIG. 1.

The transparent member 18' and the open area 18 are preferably configured within the first base member such that the transparent member is seated within the area 18. As shown in FIG. 3, the transparent area 18 may be molded to include an edge 18*a* configured to engage a corresponding edge 18*a'* on the transparent member 18'. The edges 18*a*, 18*a'* are then secured together as described above.

Figure 2:
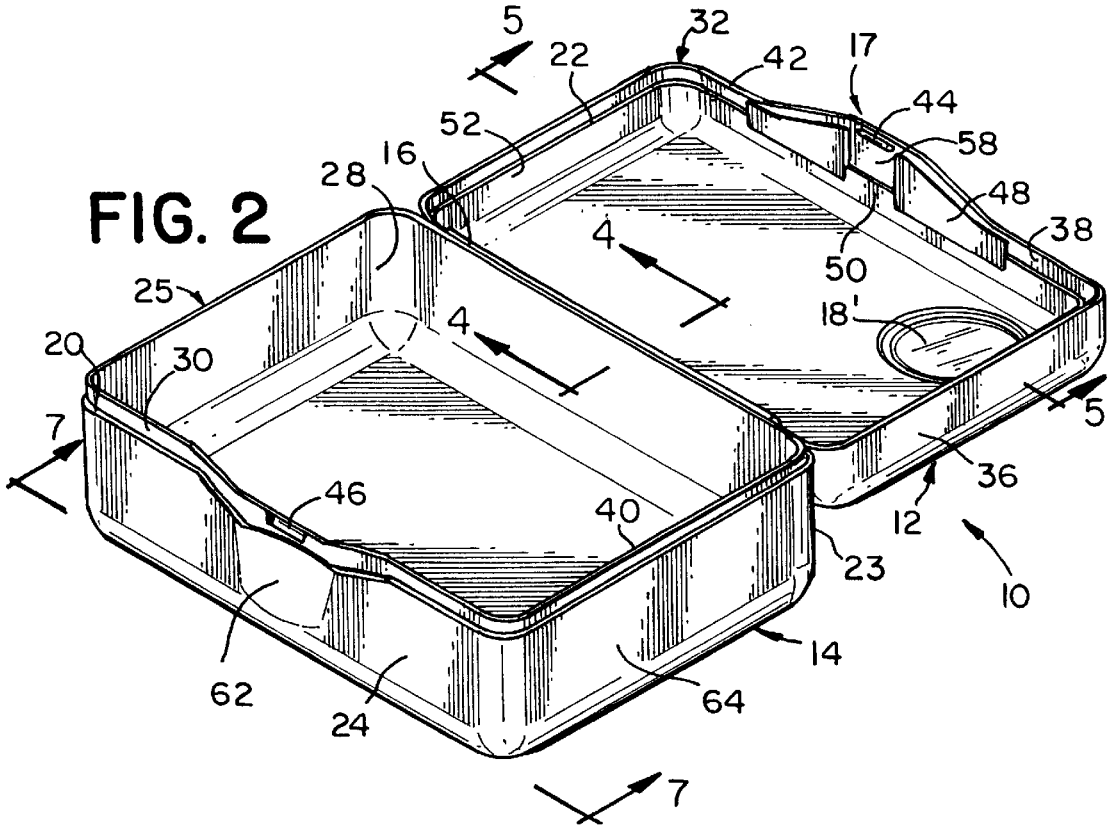
FIG. 2 is a perspective view of a container of according to the present invention in the open position.

As shown in FIGS. 1 and 2, the first base member 12 and the second base member 14 are configured such that when the container 10 is in the closed position, the peripheral edge 22 of the first base member 12 and the peripheral edge 20 of the second base member 14 are coupled. In addition, in the closed position, a hollow interior space 21 is defined for receiving an object, and, preferably, a number of objects, such as object 19 shown in FIG. 1.

The hinge 16 interconnects the peripheral edge 22 of the first base member 12 and the peripheral edge 20 of the second base member 14 such that the second base member 14 is movable with respect to the first base member 12 between a closed position as shown in FIG. 1 and an open position as shown in FIG. 2. In the open position, the first and second base members 12, 14 are uncoupled except at the hinge 16 and are at least partially spaced from each other.

The hinge 16 may be of any suitable type and may interconnect the first and second base members 12, 14 at any position along their respective peripheral edges 22, 20. In a preferably generally rectangular container 10 as shown in FIGS. 1 and 2, the hinge 18 is preferably located on the side 23 of the container 10 opposite the side 24 of container 10 which includes any suitable latching assembly, such as that described below.

Figure 4:
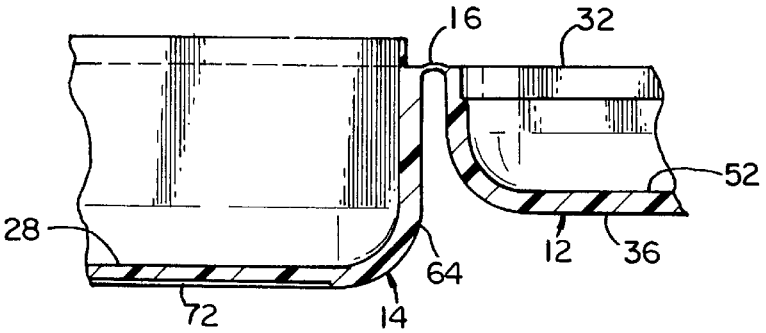
FIG. 4 is an enlarged, partial cross-sectional view taken along line 4—4 of FIG. 2.

Preferably, the container 10 is molded as a single integral piece which includes the first and second base members 12, 14 and the hinge 16, in which case the hinge 16 and the first and second base members 12, 14 are all integrally formed of the same material. It will be understood, based on this disclosure, that the hinge 16 may be formed separately of either the same or a different material than the first base member 12 or the second base member 14 without departing from the scope of the invention. When the hinge 16 is molded as integral with the first and second base members 12, 14, the hinge 16 preferably has a thickness as measured in a plane perpendicular to the longitudinal plane of the hinge 16 which is thinner than the thickness of the first and second base members 12, 14 as measured transversely across the peripheral edges 22, 20 of those members 12, 14. The hinge 16 is preferably thinner to provide flexibility over the length of the hinge 16. As shown in FIG. 2, the length of the hinge 16, as measured along the longitudinal axis of the hinge 16, is preferably less than the length of the container 10 as measured in the same direction in order to prevent portions of the hinge 16 from extending beyond the length of the container 10 such that the hinge 16 will not catch on objects or be otherwise damaged. In the open position, the hinge 16 bends such that a space 17 remains between the first and second base members as shown in FIGS. 4.

The peripheral edge 20 of the first base member 12 and the peripheral edge 22 of the second base member 14 are releasably latchable in the closed position. A latch assembly 17 releasably latches the peripheral edges 20, 22 of the first and second base members 12, 14, such that when objects 19 are stored within the container 10, the objects 19 may be secured within the container 10. Other suitable latching arrangements may be used, in view of the present disclosure, including, for example, providing the first or second base members 12, 14 with interlocking portions, a snap-fit device, a latch, a hook and similar latching or locking devices. Preferably the peripheral edges 20, 24 are releasably latchable by including interlocking flanges and a snap-fit structure as described below which may be incorporated in the molded structure of the first and second base members 12, 14.

Preferably, the peripheral edge 20 of the second base member 14 includes an interior flange 25 which extends from the peripheral edge 20 of the second base member 14. The interior flange 25 is preferably molded as part of the second base member 14 such that the interior surface 26 of the interior flange 25 is coextensive with the interior surface 28 of the second base member 14. The exterior surface 30 of the interior flange 25 preferably lies in a plane perpendicular to peripheral edge 20 of the second base member 14. In addition, it is preferred that the interior flange 25 extend around the entire periphery of the second base member 14 as shown in FIG. 2.

Figure 9:
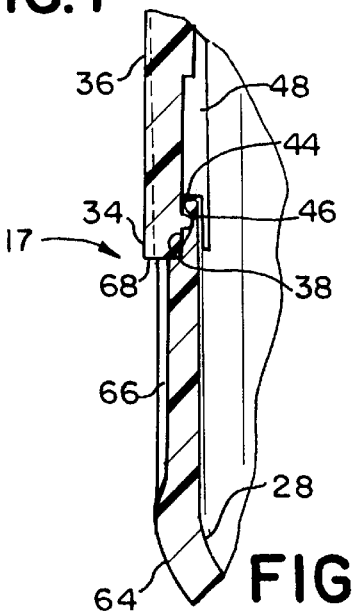
FIG. 9 is partial cross-sectional view taken along line 9—9 of FIG. 1.

If the peripheral edge 20 of the second base member 14 includes an interior flange 25, it is also preferred that the peripheral edge 22 of the first base member 12 includes an exterior flange 32 which preferably is configured such that when the container 10 is in the closed position, the interior flange 25 and exterior flange 32 fit securely together and overlap as shown in FIG. 9. The exterior flange 32 is preferably molded as part of the first base member 12 such that the exterior surface 34 of the exterior flange 32 is coextensive with the exterior surface 36 of the first base member 12. Preferably, the interior surface 38 of the exterior flange 32 lies in a plane perpendicular to the peripheral edge 22 of the first base member 12. The exterior flange 32, like the interior flange 25, preferably extends around the entire periphery of the first base member 12 as shown in FIG. 2. The interior flange 25 and exterior flange 32 together operate to help the container 10 to be more securely releasably latchable in the closed position.

The exterior and interior flanges 25, 32 are preferably configured such that when the container 10 is in the closed position, the flanges 25, 32 overlap. To ensure a secure overlap between the exterior flange 32 and the interior flange 25 when the container 10 is closed, the height of the interior flange 25 as measured transversely from the peripheral edge 20 of the second base member 14 to the edge 40 of the interior flange 25 is preferably substantially the same as the height of the exterior flange 32 as measured transversely from the peripheral edge 22 of the first base member 12 to the edge 42 of the exterior flange 32.

While the drawings show the exterior flange 32 located on the first base member 12 and the interior flange 25 located on the second base member 14, the interior and exterior flanges 25, 32 may be on either of the base members 12, 14 without departing from the scope of the present invention.

The interior flange 25 and exterior flange 32 are preferably made to snap-fit together by including a projection 44 and a notch 46 each located on one of either of the interior or the exterior flanges 25, 32. While the drawings show that the projection 44 is located on the interior surface 38 of the exterior flange 32 on the first base member and the notch is located on the exterior surface 30 of the interior flange 25 on the second base member, the opposite orientation would be equally effective. The notch 46 is preferably configured to receive the projection 44 when the container 10 is in the closed position. As such, the notch 46 and the projection 44 should be located such that they are aligned with one another on the flanges 25, 32. The notch 46 and the projection 44 may have any configuration in elevation view including circular, square, rectangular, triangular and the like. Preferably, as shown in FIGS. 2 and 5–9, the projection 44 has a raised generally rectangular shape. The notch 46 as shown in FIGS. 2 and 5–9 preferably has a recessed rectangular shape. The notch 46 and projection 44 are preferably molded as part of the corresponding first or second base member 12, 14 on which they are located, however, they may be separate pieces attached by an adhesive or by other similar methods.

Figure 6:
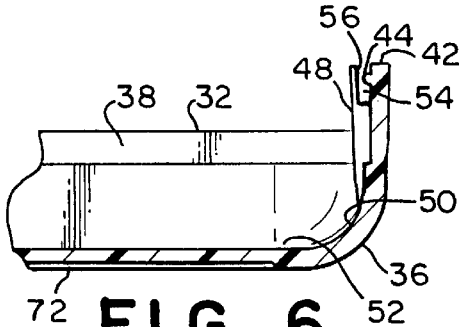
FIG. 6 is a cross-sectional view taken along line 6—6 of FIG. 5.

The latching ability of the flanges 25, 32 may also be enhanced by including at least one channel defining planar member 48 disposed inwardly from at least a portion 50 of the interior surface 52 of the first base member. The longitudinal plane of the planar member 48 is also preferably generally parallel to at least a portion 50 of the interior surface 52 of the first base member 12 which is part of the side 24 of the container 10 opposite the hinge 16 as shown in FIG. 6. Generally parallel in this instance includes a slight angle of incline between the planar member 48 and the portion 50 of the interior surface 52 of the first base member 12 of about 10°.

Figure 5:
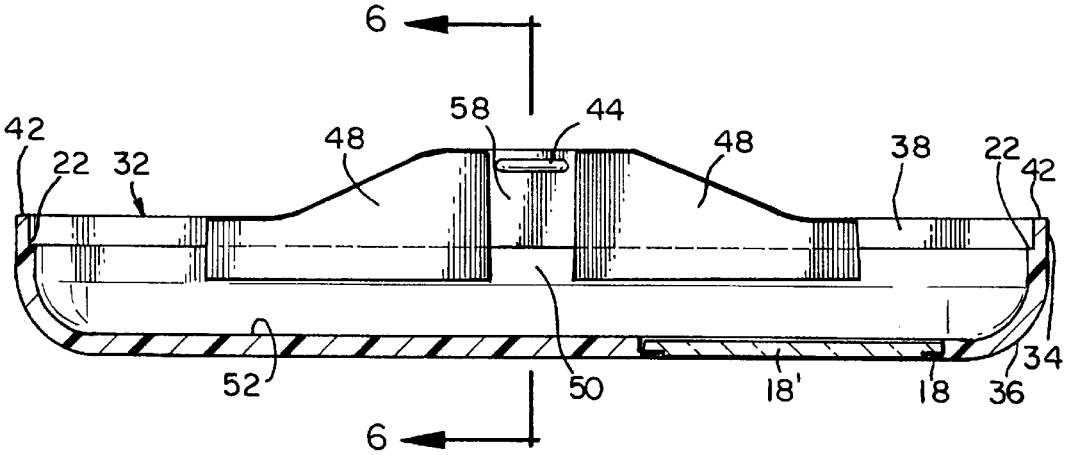
FIG. 5 is a view, partly in front elevation and partly in cross-section, taken along line 5—5 of FIG. 2.

The planar member 48 may have any suitable shape. As shown in FIGS. 2 and 5, the planar member is preferably configured such that it complements the configuration of the exterior flange 32. As shown in FIGS. 2 and 5, the planar member 48 has a curved outline which closely corresponds to the curved outline of the exterior flange 32 proximate the latching assembly 17. Preferably, there are more than one coextensive channel defining planar members 48, as shown in FIGS. 2 and 5 and the planar members 48 are molded as an integral part of the first base member 12. As shown in FIG. 6, the planar members 48 are disposed inwardly within the container 10 such that a channel 54 is formed between each of the planar members 48 and the interior surface 38 of the exterior flange 32 for receiving the interior flange 25 when the container 10 is in the closed position. The channel 54 is preferably of a thickness as measured between the interior surface 38 of the exterior flange 32 and the exterior surface 56 of the planar members 48 which corresponds roughly to the thickness of the interior flange as measured transversely across the edge 40 of the interior flange 25. The channel 54 preferably also has a depth which corresponds to the height of the interior flange 25.

The planar members 48 function to more securely latch together the base members 12, 14 by providing additional positive support to the overlapping flanges 25, 32 when placing the container 10 in the closed position. The planar members 48 also aid in holding the interior flange 25 in place against the exterior flange 32 when the container 10 is closed. In addition, if a projection 44 and notch 46 are used in conjunction with the planar members 48, the planar members 48 help to smoothly and accurately guide the interior flange 25 into the channel 54 such that the projection 44 and the notch 46 easily snap together when closing the container 10. Once closed, the planar members help to support the projection 44 and notch 46 in their latched position to prevent the container 10 from opening too easily.

The projection 44 and the notch 46 are preferably located in a space 58 between two planar members 48 such that each planar member 48 stabilizes and supports the notch 46 and projection 44 from either side. As shown in FIG. 6, if the notch 46 and projection 44 are used in conjunction with the planar members 48, the exterior surfaces 56 of the planar members 48 are preferably also slightly inclined such that edge 40 of the interior flange 25 is more easily guided past the projection 44 into the channel 54.

Figure 7:
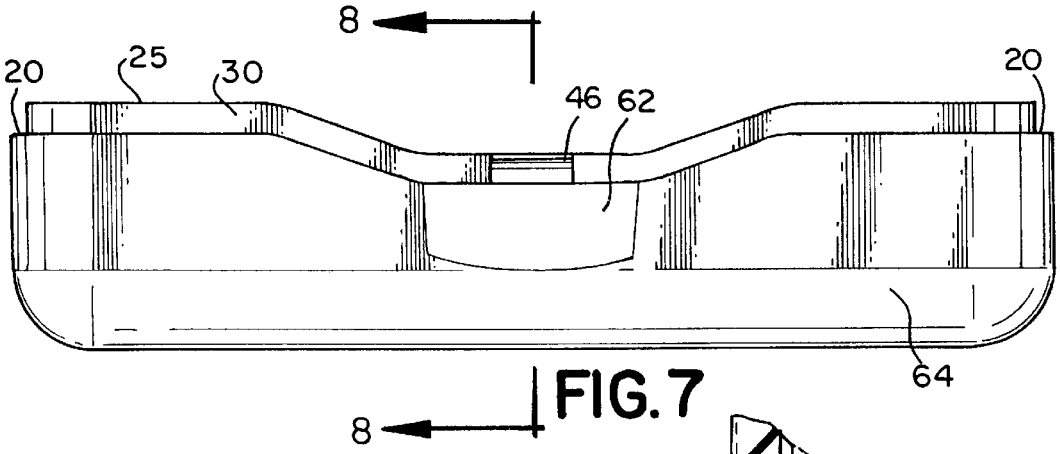
FIG. 7 is a front elevational view of the container in the open position taken along line 7—7 of FIG. 2.
Figure 8:
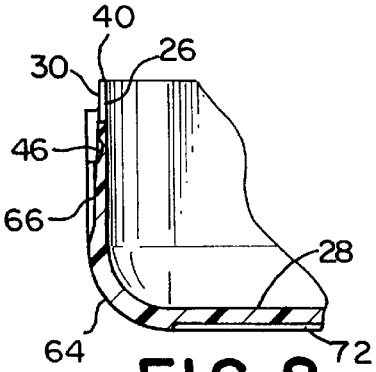
FIG. 8 is a partial cross-sectional view taken along line 8—8 of FIG. 7.

The container 10 in the closed position, may be made easier to open by making a portion 60 of the exterior surface 36 of the first base member 12 and a portion 62 of the exterior surface 64 of the second base member 14 textured as shown in FIGS. 1, 2 and 7. It will be understood, based on this disclosure, that the texturing of any portion of the exterior surface of either base member 12, 14 would also facilitate opening of the container 10.

As an alternative, or preferably in addition to providing a textured exterior surface portion to one or both of the base members, a portion 66 of the exterior surface 36, 64 of one of the first or second base members 12, 14 may be recessed inwardly such that a portion 68 of the peripheral edge of the non-recessed exterior surface of the other base member extends relatively outwardly compared to the recessed portion 66 providing an overhang 68. The overhang facilitates opening of the container. As shown in FIGS. 1, 2, 7 and 9, the textured portion 62 of the second base member 14 is recessed to create a recessed portion or depression 66 in the exterior surface 64 of the second base member 14. A corresponding textured portion 60 of the exterior surface 36 of the first base member 12 is not recessed. A portion 68 of the peripheral edge 22 of the first base member 12 extends outwardly beyond the peripheral edge 20 of the recessed textured portion 62 of the exterior surface 64 of the second base member 14 in the area of the depression 66. The extended peripheral edge portion 68 facilitates opening of the container 10 by providing a location for the application of manual force to open the container. It will be understood, based upon this disclosure, that the recessed portion 66 may be on either of the first or second base members 12, 14 and that there may be more than one recessed portion without departing from the spirit of the present invention.

In an alternative embodiment, the container 10 may be made for storing an object, such as object 19 shown in FIG. 1. In this embodiment, the container 10 includes a first base member 12 having a peripheral edge 22 which includes an exterior flange 32 as described above, a second base member 14 having a peripheral edge 20 which includes an interior flange 25 as described above and a hinge 16. In this embodiment, the first base member 12 may not include a transparent area 18. However, it is preferred that a transparent area 18 or transparent member 18' as described above be provided to the container 10 such that objects stored within the container are visible through the container 10. In this embodiment, the first and second base members 12, 14 are interchangeable and may be made from any of the materials and in any of the configurations as described above. In the closed position, the flanges 25, 32 overlap.

The objects 19 to be stored in either embodiment of the container 10 of the present invention are preferably medicaments, although many other objects, such as, for example, and without limitation, vitamins, candy and other food items, cosmetics, jewelry, childrens' toys, coins and the like, may also be stored and/or displayed in the container 10. Typical preferred medicaments for storage and/or display in the container 10 may be in the form of a tablet, caplet, capsule, or lozenge. Preferably, the medicament is a lozenge or antacid. Such medicaments are preferably also safety sealed in an airtight package within the container, such as, for example, the blister packaging 70 shown in FIG. 1. The blister package 70 preferably includes a transparent or at least translucent covering portion such that each individual medicament is visible through the packaging.

It is particularly preferred that the medicaments or objects 19 and any internal packaging are positioned within the container 10 such that the transparent area 18, or transparent member 18', which is preferably configured to be of substantially the same general shape and size of the object 19 is aligned with the object 19 to display the object 19. In this manner, consumers or users of the container 10 may view at least a portion of its contents by looking through the transparent area 18.

Other optional features which may be included on a container 10 made in accordance with the present invention include a recessed portion 72 of either of the exterior surfaces 36, 64 of the first or second base member 12, 14 which may be used to offset any labelling provided or for other aesthetic purposes. In addition, the flanges 25, 32 and peripheral edges 20, 22 of the first and second base members 12, 14 may be provided with varying outline configurations to facilitate opening of the container 10, to improve upon the overall appearance of the container 10 and/or to draw attention to the latching assembly for the container 10. For example, as shown in FIGS. 1, 2, 5 and 7, the exterior flange 32 and the peripheral edge 22 of the first base member 12 are configured to curve downwardly over the portion of the first base member proximate the latching means. In FIG. 1, the curvature is centered approximately around the textured portion 60 of the first base member 12. The interior flange 25 and the peripheral edge 20 of the second base member 14 are also curved downwardly to provide a corresponding shape to the second base member in the area proximate the textured portion 62 of the second base member 14. The curvature provided to the flanges 25, 32 and base members 12, 14 functions to draw the attention of the user toward the latching assembly of the container 10 and also provides additional surface area for the inclusion of components of the latching assembly shown, including planar members 48, projection 44 and notch 46.

The container 10 may also be molded to include such features and indicia (not shown) as product marking, instructions for use of any enclosed medicaments, manufacturers' information or the recyclable nature, if any, of the base components of the container 10. Further safety packaging (not shown), such as a shrink wrap or similar film may be provided around the exterior of the container 10 to protect the objects 19 from tampering or aging.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A container comprising:

a first base member having an exterior surface, an interior surface and a peripheral edge;

a second base member having an exterior surface, an interior surface and a peripheral edge;

a hinge interconnecting the first and second base members such that the first base member is movable with respect to the second base member between a closed position and an open position, the peripheral edges of the first and the second base members being coupled and the first and the second base members defining a hollow interior space for receiving an object to be placed therein in the closed position of the first base member and the peripheral edges of the first and the second base members being uncoupled except at the hinge and at least partially spaced from each other in the open position of the first base member;

an exterior flange extending from the peripheral edge of the one of the first and second base member towards a remaining one of the first and second base members in the closed position of the first base member;

an interior flange extending from the peripheral edge of the remaining one of the first and second base members and at least partially overlapping an inner side of the exterior flange of the one base member in the closed position of the first base member; and at least one channel-defining member on the one base member juxtaposed to and spaced inwardly from the exterior flange to define a channel with the exterior flange between the at least one planar member and an interior surface of the exterior flange receiving the interior flange in the closed position of the first base member.

2. The container according to claim 1, wherein the container in the closed position has a generally rectangular parallelepiped configuration having six adjoining surfaces, the adjoining surfaces being at generally right angles to one another.

3. The container according to claim 1, wherein the exterior flange is coextensive with the exterior surface of the one base member extending from the peripheral edge of the one base member and the interior flange is coextensive with the interior surface of the remaining base member extending from the peripheral edge of the remaining base member, and wherein the exterior and the interior flanges are configured to overlap one another when the first base member is in the closed position.

4. The container of claim 1 wherein the exterior flange is coextensive with the exterior surface of the one base member and the interior flange is coextensive with the interior surface of the remaining base member.

5. The container of claim 1 wherein a portion of the exterior surface of one of the first and second base members is recessed inwardly at the peripheral edge of the one base member and a portion of the peripheral edge of a remaining one of the first and second base members overhangs the recessed portion of the one base member in the closed position of the first base member.

6. The container of claim 1 wherein the first and second base members, the hinge, the exterior and interior flanges and the at least one channel-defining member are all molded together as a single, one-piece element.

7. The container of claim 1 wherein the exterior flange is continuous, integral and coextensive with the exterior surface of the one base member.

8. The container of claim 1 wherein the interior flange is continuous, integral and coextensive with the interior surface of the remaining base member.

9. The container of claim 1 further comprising a second channel-defining member on the one base member positioned juxtaposed to and spaced inwardly from the exterior flange and parallel with and spaced from the one channel-defining member to define another channel also receiving the interior flange in the closed position of the first base member.

10. The container of claim 1 wherein one of the interior and exterior flanges includes a projection and wherein a remaining one of the interior and exterior flanges includes a notch configured to receive the projection in the closed position of the first base member.

11. The container of claim 10 further comprising a second channel-defining member on the one base member positioned juxtaposed to and spaced inwardly from the exterior flange and parallel with and spaced from the one channel-defining member to define another channel also receiving the interior flange in the closed position of the first base member, the one channel-defining member and the second channel-defining member being further positioned on opposite lateral sides of the notch and the received projection in the closed position of the first base member.

12. The container of claim 1 wherein one of the interior and exterior flanges includes a projection and wherein a remaining one of the interior and exterior flanges includes a notch configured to receive the projection in the closed position of the first base member; and wherein a portion of the exterior surface of the remaining base member is recessed inwardly at the peripheral edge of the remaining base member and a portion of the peripheral edge of the one base member overhangs the recessed portion of the remaining base member in the closed position of the first base member.

13. The container of claim 12 wherein the exterior flange is coextensive with the exterior surface of the one base member and the interior flange is coextensive with the interior surface of the remaining base member period.

14. The container of claim 13 wherein the first and second base members, the hinge, the exterior and interior flanges and the at least one planar member are molded together as a single, one-piece element.

15. The container of claim 14 further comprising a transparent area in the first base member located such that an object placed within the container is visible through the transparent area from outside the container when the first base member is in the closed position.

16. The container of claim 1 further comprising a transparent area in the first base member located such that an object placed within the container is visible through the transparent area from outside the container when the first base member is in the closed position.

17. The container according to claim 16, wherein the transparent area is transparent member separate from the first base member and is secured to an open area of the first base member.

18. The container according to claim 17, wherein the transparent member is spin welded to the first base member.

19. The container according to claim 17, wherein the transparent member is insert molded into the first base member.

* * * * *